US006039124A

United States Patent [19]

Bowman et al.

[11] Patent Number: 6,039,124

[45] Date of Patent: Mar. 21, 2000

[54] ELECTRICAL DETECTOR ACTUATED MAGAZINE SPRINKLER (EDAMS) SYSTEM

[75] Inventors: Howard L. Bowman, Ridgecrest, Calif.; Robert L. Darwin, Arlington, Va.; William M. Maraffio; Larry D. Sawyer, both of Ridgecrest, Calif.; Robert B. Williams, Alexandria, Va.; Frank E. Hudson, Muskegon, Mich.; Mary Hunstad, Manassas, Va.; Mark W. Decker, Ridgecrest, Calif.

[73] Assignee: The United States of America as represented by the Secretary of the Navy, Washington, D.C.

[21] Appl. No.: 09/162,459

[22] Filed: Sep. 17, 1998

[51] Int. Cl.[7] ..... A62C 37/10

[52] U.S. Cl. ..... 169/61; 169/DIG. 1

[58] Field of Search ..... 169/56, 60, 61, 169/DIG. 1

[56] References Cited

U.S. PATENT DOCUMENTS

| | | | |
|---|---|---|---|
| 3,993,138 | 11/1976 | Stevens et al. | 169/61 |
| 4,082,148 | 4/1978 | Willms | 169/61 |
| 4,101,887 | 7/1978 | Osborne | 169/61 X |
| 4,227,577 | 10/1980 | Ida | 169/61 |
| 4,262,286 | 4/1981 | Tanigawa | 169/61 X |
| 4,305,469 | 12/1981 | Morrisette | 169/61 |
| 5,236,049 | 8/1993 | Asselin et al. | 169/61 |

*Primary Examiner*—Kevin Weldon

*Attorney, Agent, or Firm*—Anthony J. Serventi; Gregory M. Bokar

[57] ABSTRACT

An fire protection system for use in shipboard magazines wherein electric heat detectors in a ship magazine provide temperature data to a fire panel. Upon detection of predetermined threshold temperatures, the fire panel initiates an alarm system and activates a fire sprinkler valve to apply water to fire sprinklers in the magazine. Temperature data from the heat sensors and stored weapon response data are used by a damage control system to generate graphic display data showing thermal conditions in the magazine and estimated times and temperatures at which stored munitions will undergo thermal destruction.

13 Claims, 3 Drawing Sheets

CONSOLE DISPLAY AT FIRST INDICATION OF MAGAZINE OVER-TEMPERATURE CONDITION

OVERLAY OF WEAPONS RESPONSE DATA ON REAL-TIME MAGAZINE TEMPERATURE RISE DATA

REAL-TIME FEEDBACK OF SUCCESSFUL FIRE-FIGHTING EFFORT

ELECTRICAL DETECTOR ACTUATED MAGAZINE SPRINKLER (EDAMS) SYSTEM

CROSS-REFERENCE TO RELATED APPLICATION

Not applicable.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

MICROFICHE APPENDIX

Not Applicable.

BACKGROUND OF THE INVENTION

1. Field of the Invention

The present invention pertains generally to sprinkler systems and methods for extinguishing fires, and more particularly to an electrical detector actuated fire sprinkler system for shipboard magazines which provides high reliability, low maintenance fire protection through use of solid state electronic heat detection and by providing real-time graphic display data regarding magazine thermal conditions and fire fighting efforts.

2. Description of the Prior Art

Shipboard fires involving ordnance have long posed one of the most important threats to overall ship operation, including hull, mechanical, electrical and combat systems, as well as crew safety. Onboard ordnance fires have historically cost lives, lost mission days, and substantial expense due to repair and replacement of destroyed or damaged equipment, systems and compartments.

Magazine fire threats generally include indirect heat-up of munitions in the magazine resulting from fire in adjacent compartments, fires within the magazine which do not involve ordnance, and magazine fires involving ordnance. Once an ordnance item is heated or ignited, it may detonate, explode or burn, depending upon the explosive or propellant formulation and confinement of the ordnance. These reactions can then propagate to adjacent ordnance. Fragment or shaped-charge jet impact of solid-propellant rocket motors can initiate a propellant fire in a magazine. Once solid rocket motor propellant is ignited, it generally cannot be extinguished and will burn to completion. This type of burning facilitates propagation of a burning reaction to other solid propellant rocket motors or other items stored in the magazine in a process known as "fratricidal burning."

Conventional shipboard fire protection control systems for magazines have generally been designed to operate independently of electric power supply, following the philosophy that critical systems should be able to operate independently from power supplies which may undergo interruption during combat or other situations. Thus, shipboard fire sprinklers typically utilize hydraulic or pneumatic systems having large numbers of hydraulic and pneumatic components and valves and complex arrangements of pressure tubing. In such systems, heat sensors, upon detecting heat, transmit air or fluid pressure via pressure tubing to pneumatically or hydraulically activated valves which release water into the sprinkler system.

Currently used hydraulically and pneumatically activated fire sprinkler systems, however, have too numerous drawbacks. Particularly, hydraulic and pneumatic systems suffer from high incidences of false alarms which result in water damage to stored ordnance. Such false alarms are due in part to the pneumatically released valves used with such systems, which are generally very sensitive to the manner in which they are set and reset. These valves are often reset incorrectly by crew members, and the incorrectly set valves are easily "tripped" and result in water flow through the magazine sprinkler system. Additionally, the hydraulic and pneumatic components of such systems are prone to leakage and require frequent maintenance. Further, hydraulic and pneumatic control systems require large and complex arrangements of high-pressure lines or tubing which are inherently heavy and add to the overall weight of the ship. Still further, pneumatically released valves used with such systems are relatively complex and expensive and add to the overall cost of fire sprinkler systems. Finally, electrical power backup systems have become available which eliminate the need for hydraulically and pneumatically activated magazine sprinkler systems.

Another deficiency in currently used shipboard magazine fire sprinkler systems is that such systems provide no feedback to shipboard personnel regarding magazine temperature conditions and the effectiveness of fire fighting efforts. The only feedback provided by presently used magazine fire sprinkler systems is usually a simple alarm bell and or alarm light which alerts personnel to the presence of a potential fire situation. Thus, in order to determine if a fire is in progress or if fire fighting efforts are effective, a crew member is often sent to physically "feel" or touch the door to the magazine and or bulkheads adjacent to the magazine. Such methods of evaluating magazine fire conditions are inherently dangerous and unreliable.

Accordingly, there is a need for an electrical detector actuated magazine sprinkler system which uses solid state electronic fire detection and does not rely on hydraulic or pneumatic activation, which is not prone to false alarms or leakage, which does not cause inadvertent magazine flooding and ordnance damage, which is simple and lightweight, which utilizes inexpensive components, which requires low maintenance, and which provides real time feedback regarding magazine temperature conditions and fire fighting efforts. The present invention satisfies these needs, as well as others, and generally overcomes the deficiencies found in the background art.

SUMMARY OF THE INVENTION

The present invention is an detector actuated magazine sprinkler system which is simple, lightweight, relatively inexpensive and requires low maintenance, and which avoids false alarms and leakage. Hereinafter, activated is equivalent to actuated. The invention utilizes solid state electronic detectors to avoid the many problems associated with currently used magazine fire sprinkler systems. The invention also provides real time feed back of magazine temperature conditions to ship crew members in the form of graphic display data. In general terms, the sprinkler system of the invention comprises one or more electronic heat detectors, means for generating signals and/or alarms responsive to output from the heat detectors, a pilot valve operatively coupled to the signal generating means, a sprinkler control valve operatively coupled to the pilot valve, and one or more sprinklers.

By way of example, and not of limitation, in a first embodiment of the invention the heat sensors preferably comprise fixed temperature/rate of rise or fixed temperature/ rate compensated sensors which generate analog electric output signals corresponding to sensed temperature. The signal generating means preferably comprises a fire control board or panel which is interfaced to the heat detectors. The fire control panel, in its simplest form, generates an alarm signal or signals upon detection of a selected threshold temperature or temperatures by the heat detectors. The fire panel also authorizes water flow to the sprinklers upon detection of a preset threshold temperature by signaling the pilot valve when sensed temperature has reached a selected threshold. The pilot valve is preferably a conventional solenoid operated pilot valve which receives signals from the control panel and which is mechanically interfaced with the sprinkler control valve. Upon receiving an appropriate signal from the fire panel, the solenoid operated pilot valve physically opens the sprinkler valve to apply water to the sprinklers. Preferably, one or more manual overrides are provided which allow manual activation of the sprinkler system in the event of emergency or damage to the control panel.

In an alternative embodiment, the heat sensors are addressable and provide digital output to the fire panel. The fire panel utilizes the heat sensor output to provide self diagnostic data and real time-temperature data, as well as alarm signals, to a damage control system. The damage control system generates graphic representations of the real-time temperature data and communicates the graphic representations to consoles or monitors for display at the ship's damage control center, combat information center, bridge, or other locations. The temperature data are compared graphically with thermal threat data for weapon systems stored in the magazine to generate and display weapon system response curves according to the real-time temperature data. The displayed temperature data additionally provides real-time feedback regarding fire-fighting efforts.

An object of the invention is to provide a fire protection system for use in shipboard magazines.

Another object of the invention is to provide a fire protection system which utilizes electronic, solid state heat detection system instead of conventional hydraulic shipboard heat detection systems.

Another object of the invention is to provide a fire protection system which can be used in motor vehicles, engine compartments, fuel storage facilities and other environments subject to fire hazards.

Another object of the invention is to provide a fire protection system which reduces or eliminates false alarms and inadvertent sprinkler activation which can damage stored ordnance.

Another object of the invention is to provide a fire protection system which is not prone to leakage.

Another object of the invention is to provide a fire protection system which requires low maintenance.

Another object of the invention is to provide a fire protection system which is simple and inexpensive.

Another object of the invention is to provide a fire protection system which provides real-time feedback of magazine temperature conditions.

Another object of the invention is to provide a fire protection system which compares real-time magazine temperature feedback to thermal threat data for stored ordnance.

Further objects and advantages of the invention will be brought out in the following portions of the specification, wherein the detailed description is for the purpose of fully disclosing the preferred embodiment of the invention without placing limitations thereon.

BRIEF DESCRIPTION OF THE DRAWINGS

The present invention will be more fully understood by reference to the following drawings, which are for illustrative purposes only.

DETAILED DESCRIPTION OF THE PREFERRED EMBODIMENTS

Figure 1:
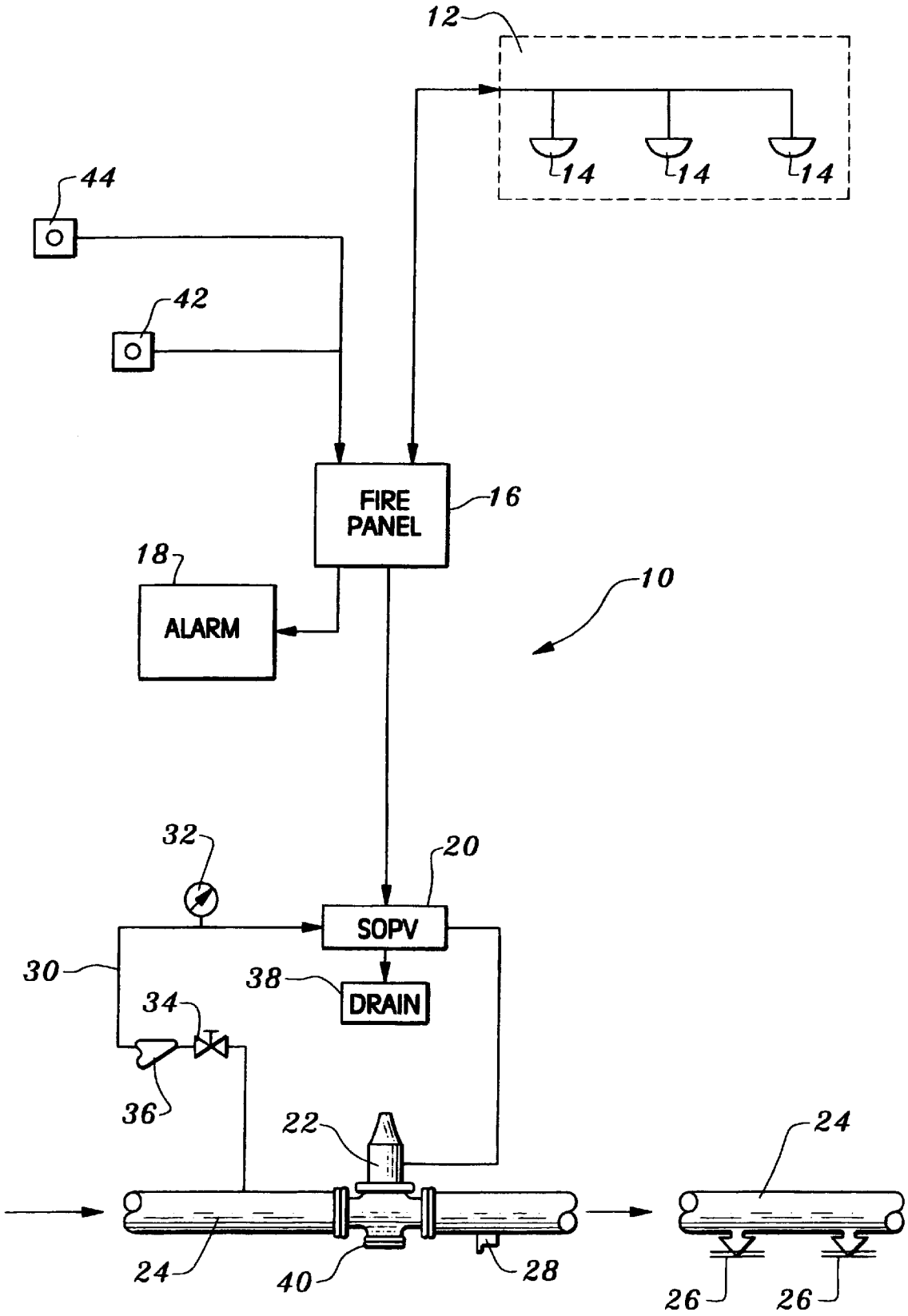
FIG. 1 is a functional block diagram of a fire protection system in accordance with the invention.

Referring more specifically to the drawings, for illustrative purposes the present invention is embodied in the apparatus shown FIG. 1 through FIG. 5. It will be appreciated that the apparatus may vary as to configuration and as to details of the parts without departing from the basic concepts as disclosed herein. The invention is disclosed generally in terms of shipboard use for magazines. The fire protection system of the invention, however, may be used for land-based as well as shipboard magazines, and may be used in various non-magazine locations, including residential and commercial buildings, motorized vehicles, engine compartments, cargo and fuel vehicles and containers, and like situations where fire hazards exists. Numerous other fire prevention uses for the invention will suggest themselves to persons of ordinary skill in the art. Referring first to FIG. 1, a fire protection system 10 in accordance with the invention is generally shown. The fire protection system 10 includes detector means for sensing heat, which preferably comprises a low voltage detector circuit 12 with a plurality of electronic heat detectors 14 thereon. Heat detectors 14 are preferably electronic fixed temperature/rate-of-rise or fixed-temperature/rate-compensated detectors which are suitably positioned within a magazine to detect temperature increases in the magazine due to fire or other source of heat. Smoke and/or flame detectors may alternatively be used in place of heat detectors 14, but are generally less preferred due to their higher susceptibility to false alarm. The presently preferred heat detectors 14 are fixed-temperature/rate-compensated detectors manufactured by Kiddy-Fenwal, Inc. of Ashland Mass., which meet U.S. Navy requirements for shock, vibration and electromagnetic interference (EMI) resistance.

The invention also comprises means for generating signals or data according to or responsive to output from heat detectors 14 and communicating corresponding signals or data to various parts of fire protection system 10. The signal generating means is shown generally as a release panel or fire panel 16, which is operatively coupled or electrically interfaced with heat detectors 14. Fire panel 16 preferably utilizes IT21 protocol and includes internal logic, provided by hardware and or software, for generating signals which activate alarm signals to indicate fire conditions according to output from heat detectors 14. Fire panel 16 further includes logic for authorizing application of water to the sprinkler system according to output from heat sensors 14, as described further below. Fire panel 16 also preferably includes logic for generating signals indicative of circuit faults or power loss associated with fire protection system 10.

Means for generating an alarm or alarms, responsive to signals from fire panel 16, are included with the invention and are shown generally as alarm 18. Alarm 18 may comprise a conventional alarm bell or siren (not show), a flashing red light (not shown) or other standard alarm indica for fires which are suitably located to apprise persons of fire threats to the magazine and the need for fire fighting efforts. Thus, alarm 18 will typically be located on the bridge, in the damage control center and/or in the combat information center of a ship using the fire protection system 10. Alarm 18 may also include indica for providing notice to personnel of circuit faults or power outages associated with fire protection system 10 according to signals from fire panel 16.

Means for actuating a sprinkler valve are included with the invention, preferably in the form of a conventional solenoid operated pilot valve or SOPV 20, which is operatively coupled to or electrically interfaced with fire panel 16. Solenoid operated pilot valve 20 is mechanically interfaced with a conventional sprinkler control valve 22 and physically opens sprinkler control valve 22 upon receiving an appropriate signal from fire panel 16. Sprinkler control valve 22 is located in a water line or pipe 24 that communicates with a firemain (not shown) which provides sea water to a plurality of fire sprinklers 26. Fire sprinklers 26 are positioned within a magazine in a manner which is optimal for extinguishing fires therein. Thus, when solenoid operated pilot valve 20 receives an activation signal from fire panel 16, solenoid operated pilot valve 20 opens sprinkler control valve 22 to allow sea water through water line 24 to fire sprinklers 26. A water switch or "FH" circuit 28 is preferably associated with water line 24 at a point downstream from sprinkler control valve 22. Water switch circuit 28 is generally a stand-alone device and generally comprises a bowl or container with a pair of electrical contacts located therein. When seawater enters water switch circuit 28 via water line 24, current passes between the electrical contacts via the electrolytes dissolved in the seawater to generate a signal which is communicated to shipboard personnel to provides indica showing that water is flowing to fire sprinklers 26. Water switch circuit 28 may alternatively be electrically interfaced or operatively coupled with fire panel 16 such that signals are sent to fire panel 16 and alarm 18 to indicate that water is flowing to sprinklers 26.

A water line 30, located upstream from sprinkler control valve 22, communicates with solenoid operated control valve 20. A pressure gauge 32 in water line 30 allows personnel to check the upstream water pressure from the fire main. A manual shutoff valve 34 in water line 30 allows maintenance access for personnel, and a "Y"-strainer 36 is included in line 30 to remove insoluble contaminants from seawater from reaching solenoid operated control valve 20. Water pressure from line 30 is utilized by solenoid operated pilot valve 20 in a conventional manner to mechanically open sprinkler control valve 22 by acting on a diaphragm (not shown) associated with control valve 22. When solenoid operated control valve 20 is turned off, either manually or according to a signal from fire panel 16, such that sprinkler control valve 22 is closed, residual water in solenoid operated control valve 20 is directed to drain 38. A flushing and test casting connection 40 is included in water line 24 adjacent sprinkler control valve 22 which allows attachment of a fire hose so that the fire protection system 10 can be tested without directing water to sprinklers 26. Means for injecting surfactant or detergent into water line 24 may be included in association with water line 24 such that an aqueous film-forming foam (AFFF) is supplied to sprinklers 26.

The invention includes override means for opening and closing solenoid operated control valve 20 and opening sprinkler control valve 22, preferably in the form of one or more local manual override switches or buttons 42, and one or more remote manual override switches or buttons 44. Local and remote override switches 42, 44 are electrically interfaced or operatively coupled to fire panel 16. Local and remote override switches 42, 44, when manually activated, provide a signal to fire panel 16 which is communicated to solenoid operated pilot valve 20. Thus, in the event that communication between detector circuit 12 and fire panel 16 has been disrupted or a malfunction has occurred due to an onboard weapon strike, or a fire (external to the magazine) exists which threatens the magazine, or other cause, personnel can open and close solenoid operated pilot valve 20 to activate or open sprinkler control valve 22 and supply water to sprinklers 26 by manually activating local override switch 42. If fire or other hazard or damage prevents personnel from accessing local override switch 42, solenoid operated pilot valve 20 can be activated to open sprinkler control valve 22 via remote override switch 44. Solenoid operated pilot valve 20 also generally includes a manual release handle (not shown) which allows personnel to manually open and close sprinkler control valve 22 to provide water to sprinklers 26.

In the operation of fire protection system 10, heat detectors 14 in the ship magazine generate analog output corresponding to sensed magazine temperature, which is communicated to fire panel 16. When fire panel 16 receives heat detector output which indicates a pre-selected or predetermined threshold temperature, fire panel 16 generates an alarm activation signal and communicates the signal to alarm 18, which in turn activates indica in the form of an alarm bell, siren, flashing light or the like, to alert personnel to the fire threat in the magazine. Typically, a temperature threshold of 105° F. is selected for alarm activation by an "F" circuit high temperature alarm circuit, although this temperature threshold may be varied depending upon the types of ordnance stored in the magazine. Generally, fire sprinkler control valve 22 is not immediately activated at the preselected temperature (105° F.), but is instead activated at a second, higher predetermined temperature, in order to allow personnel to investigate the magazine and initiate fire prevention efforts prior to activating sprinklers 26. The second, higher predetermined temperature threshold is preferably 160° F., plus or minus three degrees. When fire panel 16 receives heat detector output which indicates the second, higher predetermined threshold temperature, fire panel 16 generates an activation signal which is communicated to, and opens, solenoid operated pilot valve 20, which in turn mechanically opens magazine sprinkler control valve 22 to allow water from the firemain to flow to fire sprinklers 26 via waterline 24. In the event of an emergency or system malfunction, personnel can override the system and open sprinkler control valve manually via local or remote override switches 42, 44, or by manually activating solenoid operated pilot valve 20.

Figure 2:
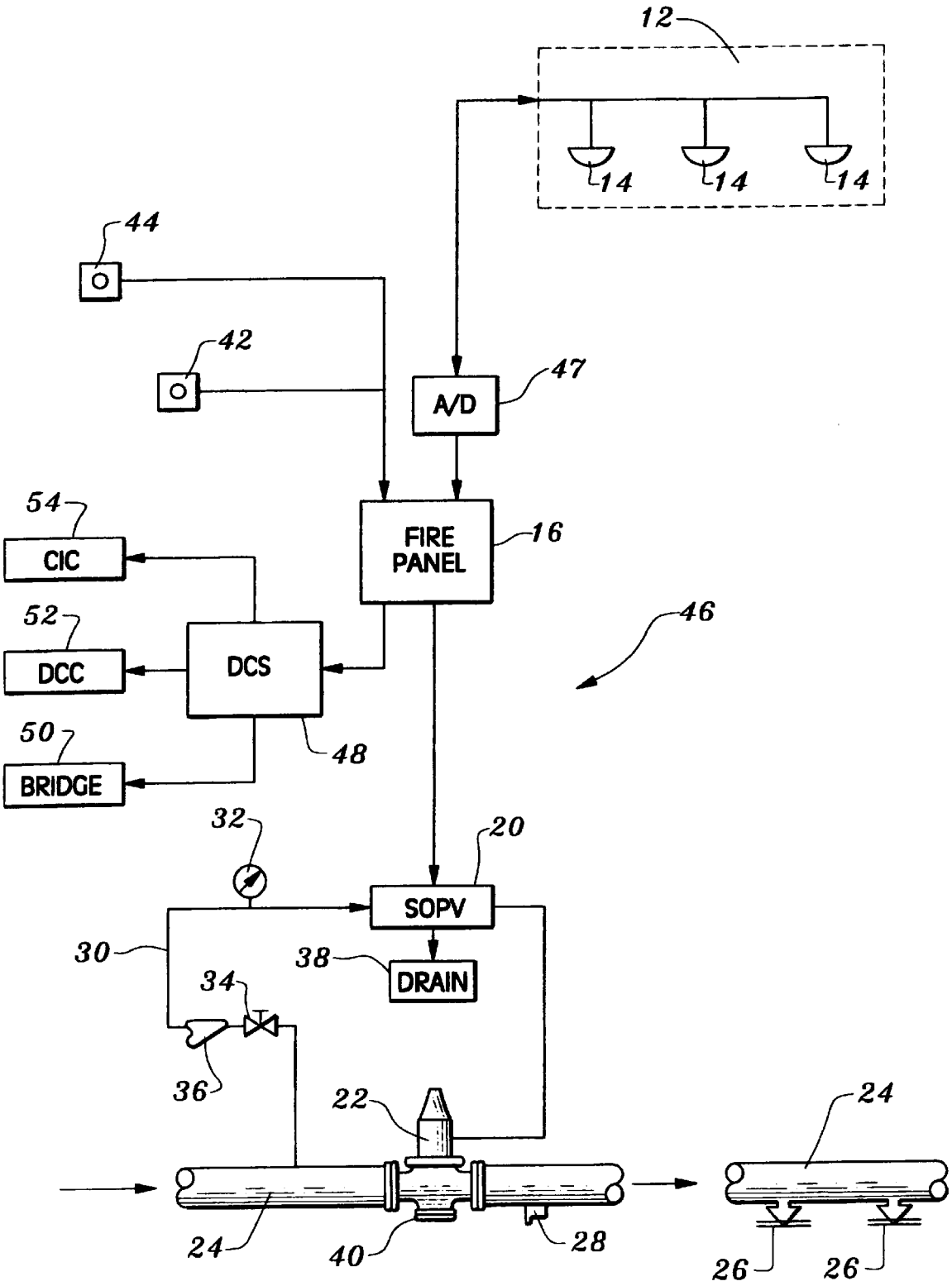
FIG. 2 is a functional block diagram of an alternative of a embodiment fire protection system in accordance with the present invention.

Referring now to FIG. 2, an alternative embodiment fire protection system 46 is shown, wherein like reference numerals denote like parts. In the fire protection system 46, heat detectors 14 are addressable and provide digital output in the form of real-time temperature data and self-diagnostic data. Means for digitizing output from heat detectors 14 is shown generally as a conventional analog-to digital or A/D converter 47. A/D converter may be integrated into fire panel 16 or associated with electronic heat detectors 14. Fire panel 16 includes internal logic which allows fire panel 16 to periodically address or query each heat detector 14 in circuit 12, and to receive corresponding responsive output from heat detectors in the form of real-time temperature data as sensed by heat detectors 14, and data regarding the operational status of each heat detector 14. In this regard, fire panel 16 preferably includes an internal processor (not shown) which carries out programmed operations for periodically querying heat detectors 14 and noting or receiving responsive output therefrom.

Fire protection system 46 includes a damage control system or DCS 48, which is electronically interfaced or operatively coupled to fire panel 16 so that fire panel 16 can communicate real-time temperature data and heat detector self diagnostic data from heat detectors 16 to damage control system 48. Damage control system 48 preferably has a processor (not shown) with conventional RAM, ROM and user I/O means suitable for running programmed operations. Damage control system 48 runs software which carries out operations for generating graphic display data and providing or communicating the graphic display data to consoles, displays or monitors (not shown) at various shipboard locations. As shown in FIG. 2, graphic display data is relayed to displays or consoles on the ship's bridge 50, damage control system (DCC) 52 and combat information center (CIC) 54.

Figure 3:
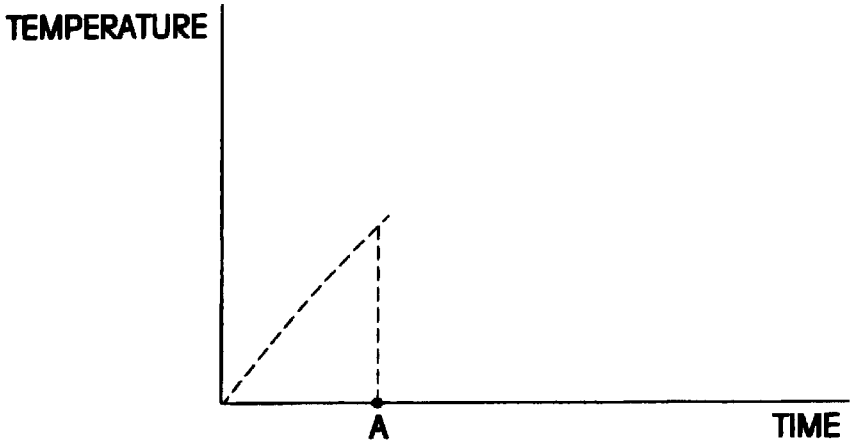
FIG. 3 is a graphic display of real-time magazine temperature data in accordance with the invention.
Figure 4:
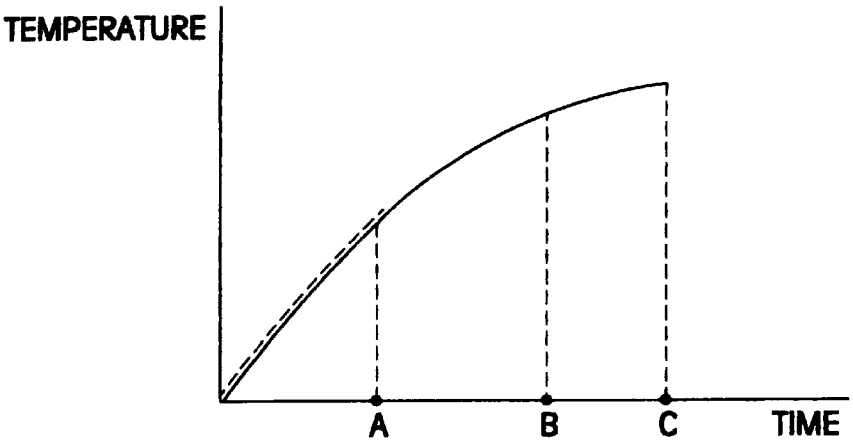
FIG. 4. is a graphic display of real-time magazine temperature data with overlaid weapons response data in accordance with the invention.

Referring also to FIG. 3, damage control system 48 includes program means for generating real time temperature graphic display data according to temperature sensed by heat detectors 14. The program means preferably comprises conventional software for generating an graphic display data in the form of an XY plot of temperature versus time, and periodically updating the plot according to output from detectors 14. Preferably, when a predetermined or preselected magazine temperature is sensed by detectors 14, such as, for example, a temperature threshold of 105° F., alarm means are activated in the manner described above to sound an alarm and alert the ship's company that the magazine is over temperature and that a threat is developing. At generally the same time, the consoles at the bridge 50, damage control central 52 and combat information center 54 will display graphic display data in the form of a temperature/time curve which indicates the rate of temperature increase in that magazine and also indicates that, at the present time, shown as time A, the ship magazine has reached a temperature threshold (such as 105° F.) at time A which presents a threat. Fire panel 16 periodically queries heat detectors 14, which periodically provide temperature data for use by damage control system 48 to update the real time temperature graphic display data curve. Damage control system 48 also includes stored data regarding the response of weapons stored in the magazine to heat or temperature. In shipboard magazines with mixed munitions stowage, data for the most heat sensitive weapon is generally utilized by damage control system 48. Referring also to FIG. 4, damage control system 48 includes program means for generating weapon response graphic display data and comparing or overlaying the weapon response graphic display with the real time temperature graphic display data to generate an XY plot of temperature versus time curves as shown in FIG. 4. The weapon response display data curve is preferably based on the thermal characteristics of the most sensitive ordnance stored in the magazine. The weapon response graphic display data is relayed or communicated to displays in the bridge 50, damage control central 52 and combat information center 54.

In FIG. 4, the real time magazine temperature curve (dashed line) is shown overlaid on the weapon response curve (solid line). Also shown with the weapon response curve is an estimated "point of no return" shown generally as time B, which indicates the time (and temperature), according to stored weapon response data, at which the weapon will start to undergo self heating. After time B, the stored weapon system will progress towards a detonation, deflagration or otherwise "cook off" (undergo a runaway thermal reaction) or undergo some other form of destruction due to the thermal conditions in the magazine, regardless of firefighting efforts. The actual cook off or detonation time for the weapon is shown by time C, where the weapon has reached a temperature which results in destruction. The time interval between the present time A and the point of no return time B indicates the amount of time or duration available in which successful firefighting efforts may be carried out. The time interval between the point of no return time B and cook off time C indicates the safety factor or additional time available, in the event that firefighting efforts are unsuccessful, during which evacuation of the magazine area can be carried out. Shipboard personnel can use the time interval between time A and time B to coordinate firefighting efforts and the time interval between time A (and/or time B) and time C to coordinate evacuation efforts.

Figure 5:
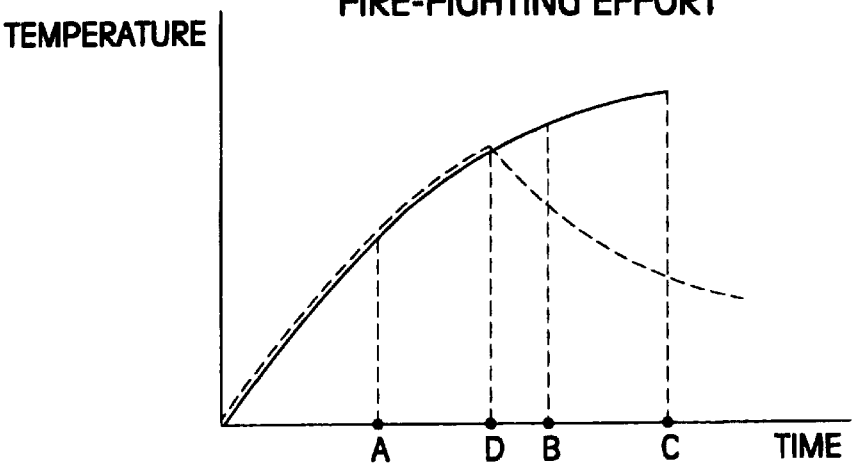
FIG. 5 is a graphic display of real-time magazine temperature data with overlaid weapons response data which shows feedback from fire-fighting efforts.

Referring also to FIG. 5, damage control system 48 further comprises program means for generating real time fire-fighting effort graphic display data and comparing or overlaying the real time fire-fighting effort graphic display data with the weapon response graphic display data. The weapon response graphic display data is shown as an XY curve (solid line), and is overlaid with the real-time fire-fighting effort graphic display data, shown as a curve (dashed line) following time D. Time D represents the point at which output from heat detectors 14 indicates that the predetermined temperature for sprinkler activation has been reached. At time D, fire panel 16 generates an activation signal which is communicated to, and activates, solenoid operated pilot valve 20, which in turn mechanically opens magazine sprinkler control valve 22 to allow water from the firemain to flow to fire sprinklers 26 via waterline 24, in the manner described above. The real time firefighting effort display data is generated according to output from heat detectors 14 after fire sprinklers 26 have been activated and are applying water to the ship magazine to extinguish fire and/or reduce magazine temperatures. The weapon response graphic display data and overlaid real-time firefighting effort graphic display data are relayed to displays or consoles on the ship's bridge 50, damage control central (DCC) 52 and combat information center (CIC) 54.

The solid state electronic heat detectors utilized with the invention offer substantial advantages over conventional shipboard hydraulic or pneumatic heat detectors, in terms of increased reliability, reduced rate, reduced complexity and reduced false alarms compared to currently used magazine fire sprinkler systems. The real-time magazine temperature data and real-time feedback on fire fighting efforts provided by the invention also offer substantial improvements over current state of the art magazine fire fighting systems. Previously, shipboard personnel have been forced to rely on very inaccurate methods, such as physically touching or feeling doors and bulkheads, to detect the level heat in a magazine and determine fire conditions and fire fighting effectiveness in a ship magazine. The present invention provides this information in the form of real-time graphic display data to appropriate shipboard personnel at safe locations.

Accordingly, it will be seen that this invention provides an electric detector actuated magazine sprinkler system which is simple, lightweight, relatively inexpensive and requires low maintenance, and which avoids false alarms and leakage. Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A fire protection system, comprising:

a. detector means for sensing heat;

b. means for generating and communicating signals according to output from said detector means, so that said signal generating and communicating means interfaces with said detector means;

c. a sprinkler valve;

d. means for actuating said sprinkler valve, so that said actuating means interfaces with said signal generating and communicating means and said actuating means interfaces with said sprinkler valve;

e. a sprinkler, so that said sprinkler is in flow communication with said sprinkler valve;

f. means for digitizing output from said detector means; and g. damage control means for generating display data, so that said damage control means interfaces with said signal generating and communicating means, and wherein said damage control means comprises program means for generating real time temperature graphic display data corresponding to heat sensed by said detector means.

2. The fire protection system according to claim 1, further comprising means for generating an alarm, so that said alarm generating means interfaces with said signal generating means.

3. The fire protection system according to claim 1, further comprising override means for controlling said actuating means, so that said override means interfaces with said signal generating and communicating means.

4. The fire protection system according to claim 1, wherein said damage control means further comprises program means for generating weapon response graphic display data and comparing said weapon response graphic display data with said real time temperature graphic display data.

5. The fire protection system according to claim 1, wherein said damage control means further comprises program means for generating real time fire-fighting effort graphic display data and comparing said real time fire-fighting effort graphic display data with said weapon response graphic display data.

6. A magazine fire protection system, comprising:

a. detector means for sensing heat;

b. fire panel means for generating and communicating signals responsive to said detector means, so that said fire panel means is operatively coupled to said detector means;

c. a sprinkler valve;

d. solenoid means for actuating said sprinkler valve, so that said solenoid means is operatively coupled to said fire panel means and said solenoid means mechanically interfaces with said sprinkler valve;

e. a sprinkler, so that said sprinkler is in flow communication with said sprinkler valve;

f. means for digitizing output from said detector means; and g. damage control system, so that said damage control system is operatively coupled to said fire panel means, and wherein said damage control system comprises program means for generating real time temperature graphic display data corresponding to heat sensed by said detector means.

7. The magazine fire protection system according to claim 6, further comprising means for generating an alarm, so that said alarm generating means is operatively coupled to said fire panel means.

8. The magazine fire protection system according to claim 6, further comprising override means for controlling said solenoid means, so that said override means is operatively coupled to said fire panel means.

9. The magazine fire protection system according to claim 6, wherein said damage control system further comprises program means for generating weapon response graphic display data and comparing said weapon response graphic display data with said real time temperature graphic display data.

10. The magazine fire protection system according to claim 9, wherein said damage control system further comprises program means for generating real time fire-fighting effort graphic display data and comparing said real time fire-fighting effort graphic display data with said weapon response graphic display data.

11. A magazine fire protection system, comprising:

a. detector means for sensing heat;

b. means for digitizing output from said detector means;

c. fire panel means for generating and communicating signals responsive to said detector means, so that said fire panel means is operatively coupled to said detector means;

d. a sprinkler valve;

e. solenoid means for actuating said sprinkler valve, so that said solenoid means is operatively coupled to said fire panel means and said solenoid means mechanically interfaces with said sprinkler valve;

f. a sprinkler, so that said sprinkler is in flow communication with said sprinkler valve; and g. damage control means for generating display data, so that said damage control means is operatively coupled to said fire panel means, and wherein said damage control means comprises program means for generating real time temperature graphic display data corresponding to heat sensed by said detector means.

12. The magazine fire protection system according to claim 11, wherein said damage control means further comprises program means for generating weapon response graphic display data and comparing said weapon response graphic display data with said real time temperature graphic display data.

13. The magazine fire protection system according to claim 12, wherein said damage control means further comprises program means for generating real time fire-fighting effort graphic display data and comparing said real time fire-fighting effort graphic display data with said weapon response graphic display data.

* * * * *

UNITED STATES PATENT AND TRADEMARK OFFICE
CERTIFICATE OF CORRECTION

PATENT NO. : 6,039,124

DATED : March 21, 2000

INVENTOR(S) : Bowman, Darwin, Maraffio, Sawyer, Williams, Hudson, Hunstad, Decker It is certified that error appears in the above-identified patent and that said Letters Patent are hereby corrected as shown below:

Title page, Under "Inventors", "William M. Maraffio" should read --William R. Maraffio--.

Signed and Sealed this

Tenth Day of April, 2001

*Attest:*

Nicholas P. Godici

NICHOLAS P. GODICI

*Attesting Officer*

*Acting Director of the United States Patent and Trademark Office*